United States Patent [19]

Hyde

[11] Patent Number: 4,573,711

[45] Date of Patent: Mar. 4, 1986

[54] SECURE CREDIT CARD AND METHOD OF MANUFACTURING SAME

[75] Inventor: Kirk R. Hyde, Palos Verdes Estates, Calif.

[73] Assignee: Kirkplastic Company Incorporated, Los Angeles, Calif.

[21] Appl. No.: 581,725

[22] Filed: Feb. 21, 1984

[51] Int. Cl.[4] ..... B42D 15/00

[52] U.S. Cl. ..... 283/98; 283/94; 283/904

[58] Field of Search ..... 283/57, 58, 904, 94, 283/98

[56] References Cited

U.S. PATENT DOCUMENTS 3,802,724 4/1974 Gosnell ..... 283/58 X 3,950,013 4/1976 Tagliaferri ..... 283/58 X

*Primary Examiner*—Paul A. Bell

*Attorney, Agent, or Firm*—Fulwider, Patton, Rieber, Lee & Utecht

[57] ABSTRACT

There is disclosed a method of manufacturing a credit card including the fabrication of a plurality of plastic credit cards, as in sheet form, and then severing such cards into individual personal cards with coded information thereon for identifying the person or account to which the cards relate. Printed on such card is indicia indicating the card is "void". Fabricated separately from the respective cards are strips of hologram material which are sized to act as covers for overlying the "void" indicia and which incorporate optical images which may be characteristic of a particular account or institution to indicate the card is currently active. The indicia covers are stored separate from the cards and are only applied thereto as a last step prior to shipment of the cards from the place of storage to the customer. Consequently, any unauthorized person who gains possession of the cards without the accompanying hologram covers will find the cards ineffective for making unauthorized transactions relating to the accounts identified by such cards.

5 Claims, 3 Drawing Figures

FIG. 1
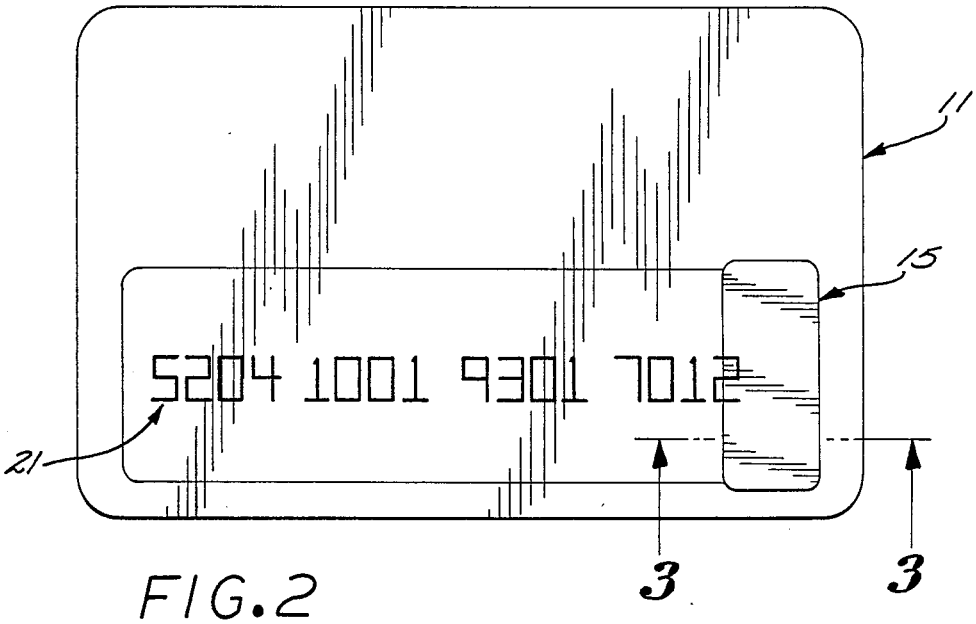
FIG. 2
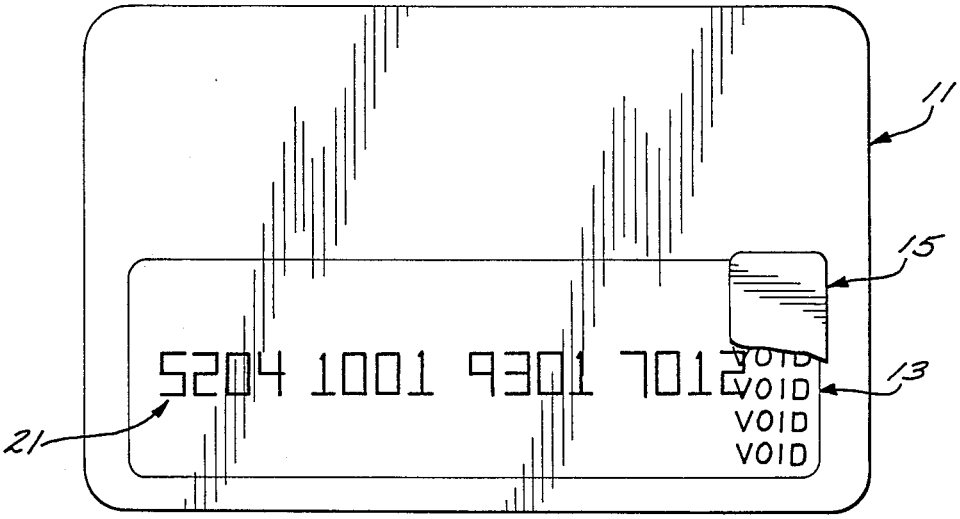
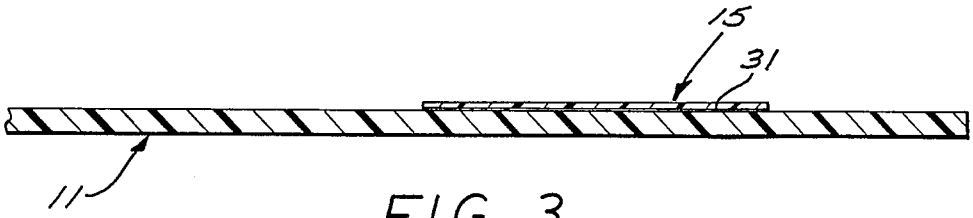
FIG. 3

SECURE CREDIT CARD AND METHOD OF MANUFACTURING SAME

BACKGROUND OF THE INVENTION

1. Field of the Invention

The present invention relates to the manufacture of credit cards and the security of such cards until release to the end user.

2. Description of the Prior Art

Plastic cards have gained great popularity in recent years as a medium by which purchase money is paid and business transacted without the necessity of carrying cash or enduring a long term escrow or other means for transferring title or securing payment of cash. With the popularity and ready acceptance of credit cards in the business world, the use thereof by unscrupulous persons to make unauthorized transaction has become a serious problem costing the consumers millions of dollars annually. As the demand for such cards has risen amongst counterfeiters and other illegal uses, the demand for improperly obtained cards market has skyrocketed thus creating an extremely high incentive for dishonest employees connected with the manufacture of such cards to succumb to temptation. Such employees are presented daily with a temptation to supply cards to persons bent on improper use thereof, all for great sums of money.

There have been many efforts in the past to assure the security of credit cards, including coding thereof for check at the point of purchase to determine if the card may be a stolen card. Other efforts have led to the construction of credit cards with a hologram strip secured to the face thereof and incorporating optical images characteristic of the particular card such that a merchant or other person to whom the card is presented will have an opportunity to examine the card to determine if the hologram is in position and to identify the characteristics of the images incorporated therein.

While many efforts have been made to provide security against illegitimate use of stolen credit cards, little effort has been made, and even less success achieved, to provide security at the place of manufacture and storage of such cards prior to distribution to the end user. Consequently, there exists a need for a method of manufacture and a credit card which discourages theft by employees yielding to the temptation to supply such cards to others or to use the cards themselves for illegitimate purposes.

SUMMARY OF THE INVENTION

The method of the present invention is characterized by manufacturing credit cards with a warning printed on the face thereof in such a manner that it will be discernable to a merchant or other individual to whom the card is presented for being honored in carrying out a transaction. An indicia cover is constructed of a strip of material having a characteristic of blocking viewing of the warning indicia, whether by magnetic, visual or other means, or such that absence of such cover will present a warning to the merchant. During manufacture, the cards and cover strips are manufactured separately and the strips maintained under heavy security, such as in a vault or safety deposit box, until the card and cover are to be married together upon shipping thereof to the end user of such cards.

Other objects and features of the invention will become apparent from consideration of the following description taken in connection with the accompany drawings.

BRIEF DESCRIPTION OF THE DRAWING

FIG. 1 is a top plan view of a credit card embodying the present invention;

FIG. 2 is a top plan view similar to FIG. 1 but with the indicia cover partially broken away; and FIG. 3 is a transverse sectional view, in a large scale, taken along the line 3—3 of FIG. 1.

DESCRIPTION OF THE PREFERRED EMBODIMENT

The credit card manufactured by the method of the present invention includes, generally, a conventional plastic card 11 having printed thereon a warning, such as the words "void" 13 and covered by means of an opaque cover strip, such as a strip of hologram material 15. Consequently, the hologram cover strips 15 are stored separately from the cards 11 from the time of manufacture until the time that they are married together for shipping to the customer for use or distribution to end users.

The cards 11 may be manufactured of plastic or any other desirable material convenient for carrying in ones wallet or purse. The card 11 typically incorporates identifying information, such as a raised sequence of numbers, generally designated 21, which will identify the account of the person to whom the card 11 is subsequently supplied for use in making purchases or other business transactions. It will be appreciated that the raised number 21 may be replaced by a magnetic code or any other convenient means for identifying the person authorized to use such card.

Printed on the card, partially in overlying relationship with the last numeral of the identifying number series 21, are the warning words "void". It will be appreciated that these words are visually preceivable by a merchant or other individual to whom the card is presented for carrying out a transaction. It will be apparent to those skilled in the art that the visual words "void" are convenient for visual reading but that other indicia may be substituted therefore, such as magnetic coding or other indicia to be read by a reader, such as a magnetic reader.

In the preferred embodiment, the plastic card 11 is fabricated in sheet form with a great number of such cards on an individual sheet of plastic and the composite series of cards on each sheet is over printed with identifying legend and other indicia desirable on such cards but not shown in these drawings. Representative of such indicia may be the trade name of the financial institution issuing the card or other legend peculiar to the particular application intended for the card. As the cards are printed, the words "void" are printed thereon during the initial manufacturing stages such that any unscrupulous person obtaining possession of the card will be discouraged from using same since the merchant to whom the card is presented will be immediately alerted to the fact that the card is void.

One means currently used in identifying the particular cards or the status of particular cards is the placement of a strip of hologram material on the front of the card such that a merchant may view the images in the hologram to determine the status of the particular card. If the card presented does not have an identifying hologram strip thereon, the merchant is immediately placed on alert to the fact that the card itself may well be a counterfeited card or is otherwise tainted. Since the technology for fabrication of hologram strips having particular characteristics is relatively expensive and sophisticated, counterfeiters do not currently have within their convenient grasp the hologram strips necessary for manufacture of cards having a convincing appearance of authenticity. These hologram strips typically have sufficient light diffusion, reflection and absorption to render the strip opaque in the direction of its thickeness, thus providing a convenient means for forming the opaque covering strip 15. In practice, the hologram covering strips 15 are fabricated in a facility separate from the facility where the credit cards 11 are fabricated thus dissuading employees from stealing such cards and making improper use thereof until such time as the covers 15 are available for application thereto. The covers 15 are stored at a facility different from the facility where the cards 11 are manufactured or are maintained of under heavy security, such as in a vault or safety deposit box.

When a series of cards 11 are to be shipped to a financial institution or to end users, the appropriate number of hologram covering strips 15 are selected and applied to the respective cards, as by pressure sensitive adhesive 31 (FIG. 3). With the covering strips 15 so applied, the warning indicia "void" is blocked from view thus indicating the credit card itself is a legitimate card.

Currently there are over one billion credit cards manufactured per year in the United States of America and security for such cards has become a concern of a particularly high priority. The liability of the manufacturer has risen to astronomical proportions due to potential employee thievery. It will be apparent from the above that the method of present invention provides a particularly effective means for controlling inventory of cards and discouraging thievery by those having access to the cards during manufacture thereof. The hologram covering strips 15 may be conveniently kept under stringent security with access thereto being had by only a few trusted employees. Consequently, security during manufacture and storage prior to shipment is maintained at a relatively high level thus limiting loss and consequent liability.

Various modifications and changes may be made with regard to the foregoing detailed description without departing from the spirit of the invention.

I claim:

1. A secure credit card comprising: a preformed card blank including a face having an operative space formed with coded information indicative of the person or persons authorized to make transactions on the account identified by said card, and a security area of a predetermined configuration;

discernable security indicia preprinted within the confines of said security area indicating that use of said card blank is unauthorized;

a preformed security cover of holographic material formed to said predetermined configuration and overlying said security area for totally obscuring said security indicia; and an adhesive sandwiched between said cover and card for securing said cover to said card whereby said card blank may be fabricated separate from said cover and said cover adhered thereto to cover said indicia as a last step of manufacture to cover said indicia.

2. A secure credit card as set forth in claim 1 wherein: said indicia being in the form of a word.

3. A secure credit card as set forth in claim 1 wherein: said cover includes a strip formed by opaque means.

4. A secure method for manufacturing credit card including the following steps: prefabricating a set of credit card blanks including the step of printing an identifying legend and discernable security indicia in a security area of predetermined configuration and forming an operative space thereon with coded information indicative of the person or persons authorized to make transactions on accounts identified by the coded information on the respective cards;

stocking said credit card blanks in inventory pending authorized release thereof;

prefabricating a set of holographic covers of said predetermined configuration to cover said security indicia on said respective card blanks to block discernment of said indicia;

storing said holographic covers in a security means pending authorized release of said respective cards;

selectively removing said set of covers from said security means and mating them with said set of cards in overlying relationship on said security indicia to render said indicia undiscernable;

affixing said covers to said cards whereby said set of covers may be conveniently stored in said security means pending authorized release of said set of cards and thereafter may be joined with the respective cards of said set to render said security indicia undiscernable to thus render the card assembly negotiable.

5. A secure method for manufacturing credit cards as set forth in claim 4 wherein:

said step of placing said indicia on said cards includes the step of printing at least one word on said cards.

* * * * *